US008555996B2

(12) United States Patent
Martinsson et al.

(10) Patent No.: US 8,555,996 B2
(45) Date of Patent: Oct. 15, 2013

(54) EXCAVATOR, MOUNTING DEVICE AND EXCAVATOR TOOL

(75) Inventors: Carl-Gustav Martinsson, Löberöd (SE); Sven-Ake Gustafsson, Höör (SE); Ulf Jönsson, Stehag (SE); Mats Kristerson, Vollsjö (SE); Jesper Nilsson, Lund (SE)

(73) Assignee: Atlas Copco Rock Drills AB, Orebro (SE)

( * ) Notice: Subject to any disclaimer, the term of this patent is extended or adjusted under 35 U.S.C. 154(b) by 356 days.

(21) Appl. No.: 12/736,603

(22) PCT Filed: Feb. 24, 2009

(86) PCT No.: PCT/SE2009/050201

§ 371 (c)(1),
(2), (4) Date: Jan. 7, 2011

(87) PCT Pub. No.: WO2009/134184

PCT Pub. Date: Nov. 5, 2009

(65) Prior Publication Data

US 2011/0108297 A1 May 12, 2011

(30) Foreign Application Priority Data

Apr. 29, 2008 (SE) ..... 0800972

(51) Int. Cl.
*E02F 3/76* (2006.01)

(52) U.S. Cl.
USPC ..... 172/816

(58) Field of Classification Search
USPC ..... 37/106, 301, 264, 280–283; 172/801–816
See application file for complete search history.

(56) References Cited

U.S. PATENT DOCUMENTS

| | | | | |
|---|---|---|---|---|
| 1,977,817 | A | 10/1934 | Bird | |
| 2,094,153 | A | 9/1937 | Harrington | |
| 3,226,858 | A | 1/1966 | Spannhake | |
| 3,265,380 | A * | 8/1966 | Hall et al. | 267/153 |
| 3,279,105 | A * | 10/1966 | Kolinger et al. | 172/816 |
| 3,478,450 | A | 11/1969 | Cunningham | |
| 3,628,265 | A * | 12/1971 | Galis | 37/106 |
| 4,031,968 | A | 6/1977 | Krolak et al. | |
| 4,133,392 | A * | 1/1979 | Freese | 172/816 |
| 4,274,493 | A | 6/1981 | Freese | |
| 5,769,168 | A | 6/1998 | Skiba | |
| 6,105,682 | A | 8/2000 | Recker et al. | |
| 7,013,983 | B2 | 3/2006 | Matsumoto et al. | |

* cited by examiner

*Primary Examiner* — Robert Pezzuto
(74) *Attorney, Agent, or Firm* — Mark P. Stone

(57) ABSTRACT

Excavator that comprises a drive unit, an excavator tool and a mounting device for the excavator tool and wherein the mounting device comprises at least two arms that are arranged to be connected to the excavator tool. The excavator comprises resilient portions located in at least two different locations in which the resilient portions are arranged to allow the excavator tool to move in at least one plane relative to the drive unit when the excavator tool is mounted on the mounting device and thereby allow the excavator tool to oscillate in the at least one plane.

20 Claims, 4 Drawing Sheets

EXCAVATOR, MOUNTING DEVICE AND EXCAVATOR TOOL

This application is a U.S. National Phase Application under 35 USC 371 of International Application PCT/SE2009/050201, filed Apr. 29, 2008.

TECHNICAL FIELD

The present invention concerns an excavator and a mounting device as well as an excavator tool for such an excavator.

BACKGROUND OF THE INVENTION

An excavator is a type of engineering machine that is mainly used for moving earth or loads, digging work and demolition. An excavator, such as a digging machine, usually comprises a drive unit that comprises an undercarriage and an overcarriage, whereby the overcarriage has a motor and cabin part that can be rotated in relation to the undercarriage. Excavators also comprise an assembly that includes an excavator tool, such as a blade, a shovel, a hook for breaking up frozen ground, an asphalt cutter or a gripping tool, that is attached to the excavator's underbody via a mounting device, and that is usually hydraulically controlled using at least a hydraulically maneuvered lift arm.

When excavating broken rock in mines with an excavator blade for example, the ground can be hard and rough and this means that large forces are required to move the excavator blade forwards. However, if one allows the excavator blade to move up and down in the vertical plane and follow the underlying surface contours the excavator blade becomes easier to move forwards. At the same time the ground becomes more scraped clean and the forces on the blade mounting device will be lower.

Blade oscillation has been used in many applications; usually the excavator blade is pivotably mounted on a shaft that extends in the excavator's forward driving direction. The excavator blade oscillates from side to side around the shaft and the compressive force, i.e. the force that moves the excavator blade forwards, is taken up by slide rails that are arranged on the shaft's periphery and the excavator blade's shaft attachment. A drawback with this construction is that the slide rails provide further resistance to the movement of the excavator blade due to frictional forces in the slide rails and the resistance to oscillate the blade thereby becomes larger in proportion to the compressive force.

Another way of achieving blade oscillation is to make the blade mounting flexible. If the blade mounting is flexible, it is twisted as the blade oscillates. There is then a great risk of fatigue damage to the excavator structure.

SUMMARY OF THE INVENTION

An object of the present invention is to provide an improved excavator.

This object is achieved by an excavator that comprises a drive unit, a removable or non-removable excavator tool, and a mounting device that comprises at least two arms that are arranged to be connected to the excavator tool. The excavator comprises resilient means that are located in at least two different locations. The resilient means are arranged to allow the excavator tool to move in at least one plane relative to the drive unit when said excavator tool is mounted on the mounting device and thereby allows the excavator tool to oscillate in said at least one plane. Since the resilient means are arranged in at least two different locations, for example on each side of the mounting device, one side of the excavator tool can move without substantially influencing the other side of the excavator tool.

The expression "resilient means" is intended to mean a device, such as a spring, or a material, such as rubber, plastic, or foam, that is intended to deform elastically. The expression excludes the unavoidable play between fixedly mounted components of an excavator, which play can result in fatigue damage of the excavator structure.

It should be noted that the expression "at least two different locations" does not exclude that the resilient means can be formed as a single structure that extends between at least two of said at least two different locations. The expression does however exclude that substantially the whole mounting device is made from resilient material. The mounting device in an excavator according to the present invention is namely rigid in all directions apart from the direction/directions for oscillation, apart from the unavoidable play between fixedly connected components of the excavator.

Such a construction provides an excavator with a robust mounting device that facilitates oscillation of an excavator tool, i.e. it facilitates the excavator tool's swinging from side to side, and/or up and down and/or in some other plane. Both the oscillation resistance and the oscillation movement's size can be varied by varying the type, the rigidity and/or the dimensions of the resilient means and/or their placement. The excavator according to the present invention is resistant to fatigue since the oscillation is taken up by the resilient means, via springs for example, and not by twisting the mounting device itself or some other part of the excavator. Furthermore the force that is used to oscillate the excavator tool is independent of the compressive force. Such an excavator therefore makes it possible to oscillate the excavator tool in an effective and simple way.

According to an embodiment of the invention the mounting device is arranged to be fixedly connected to the drive unit and the at least two arms are arranged to be movably connected to the excavator tool via first connections whereby the resilient means are arranged by said first connections. For example the resilient means are arranged at one end of each arm just by the arm connection or in the vicinity thereof. The resilient means are arranged either on the at least two arms, or on the excavator tool, therebetween, or on both the at least two arms and the excavator tool.

According to another embodiment of the invention the mounting device is arranged to be fixedly connected to the drive unit and the at least two arms are arranged to be movably connected to a part of the mounting device via second connections whereby the resilient means are arranged in said second connections. The resilient means are arranged on the at least two arms and/or on said part of the mounting device or therebetween.

According to a further embodiment of the invention the mounting device is arranged to be movably connected to the drive unit via third connections and said resilient means are arranged by said third connections. The excavator tool oscillation in this case is achieved by allowing the whole mounting device to move relative to the drive unit.

According to an embodiment of the invention the resilient means are arranged to only allow the excavator tool to move in substantially one plane relative to the drive unit, for example a vertical plane, i.e. a plane that is perpendicular to the excavator's extension in the longitudinal direction. If the excavator is, for example, to be used for excavation of a substantially vertical surface the resilient means can be arranged to only allow the excavator tool to move in a substantially horizontal plane, i.e. a plane that is perpendicular to the excavator's extension in its height direction.

According to another embodiment of the invention the resilient means comprises a resilient material, a mechanical spring, such as a cup spring, a cylindrical or conical helical spring, a ring-shaped spring, a plate spring, a spiral spring or a torsion spring. Alternatively, or additionally the resilient means can comprise a pneumatic spring. The resilient means are for example arranged to hold the excavator tool substantially horizontal when it is unloaded if the excavator is to be used for excavation of a substantially horizontal surface.

According to a further embodiment of the invention the at least two arms are lift arms. Alternatively the arms only support the excavator tool. According to another embodiment of the invention the at least two arms individually maneuverable, for example by means of hydraulic or pneumatic elements. Alternatively, the at least two arms can be arranged to be maneuvered together. An excavator tool is therefore either displaceably or non-displaceably mounted on the mounting device according to the present invention.

According to an embodiment of the invention the at least two arms are mounted in spherical bearing in the mounting device. Since all of the arms joints have spherical joint bearings instead of bushings the risk of edge cuts is eliminated.

According to another embodiment of the invention the mounting device comprises locking means in order to prevent the excavator tool from being able to move in at least one plane relative to the drive unit. For example, if the excavator is to be used for excavating a substantially horizontal surface, the excavator tool can be prevented from being able to move in the excavator's transverse direction.

The present invention concerns an excavator that is for example used in digging work, demolition, material handling, forestry or garden work, snow ploughing or dredging rivers. Such excavators can have a weight of up to 20 tons or more, and comprises a tool that can weigh up to one ton or more.

The present invention also concerns a mounting device that is arranged to be used in an excavator according to an embodiment of the invention, whereby the mounting device comprises resilient means that are located in at least two different locations, which resilient means are arranged to allow the excavator tool to move in at least one plane relative to the excavator's drive unit when an excavator tool is mounted on the mounting device and thereby allow the excavator tool to oscillate in said at least one plane.

The present invention further concerns an excavator tool, such as a blade, a shovel, a hook for breaking up frozen ground, an asphalt cutter, a refuse assembly, or a gripping tool, that is arranged to be used in an excavator according to an embodiment of the invention or to be mounted on a mounting device according to an embodiment of the invention. The excavator tool comprises resilient means that are located in at least two different locations, which resilient means are arranged to allow the excavator tool to move in at least one plane relative to the drive unit when the excavator tool is mounted on a mounting device of the excavator and thereby allow the excavator tool to oscillate from side to side in said at least one plane.

BRIEF DESCRIPTION OF THE DRAWINGS

In the following, the present invention will be described in more detail with reference to the accompanying schematic figures, in which.

It should be noted that the drawings have not necessarily been drawn to scale and that the dimensions of certain features have been exaggerated for the sake of clarity.

DETAILED DESCRIPTION OF EMBODIMENTS

Figure 1:
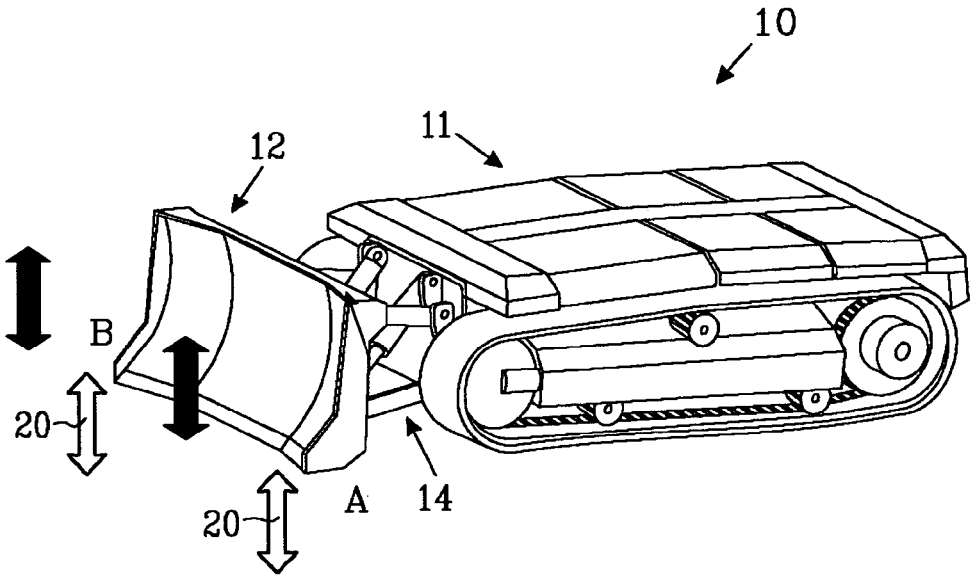
FIG. 1 shows an excavator according to an embodiment of the invention.

FIG. 1 shows an excavator 10, such as a belt excavator, that comprises a drive unit 11, an excavator tool 12, namely an excavator blade in the illustrated example, and a blade mounting device 14. Each side A, B, of the excavator blade 12 is arranged to move up and down in a substantially vertical plane as is indicated by the block arrows 20, i.e. the excavator tool 12 is arranged to oscillate from side to side in the substantially vertical plane.

Figure 2:
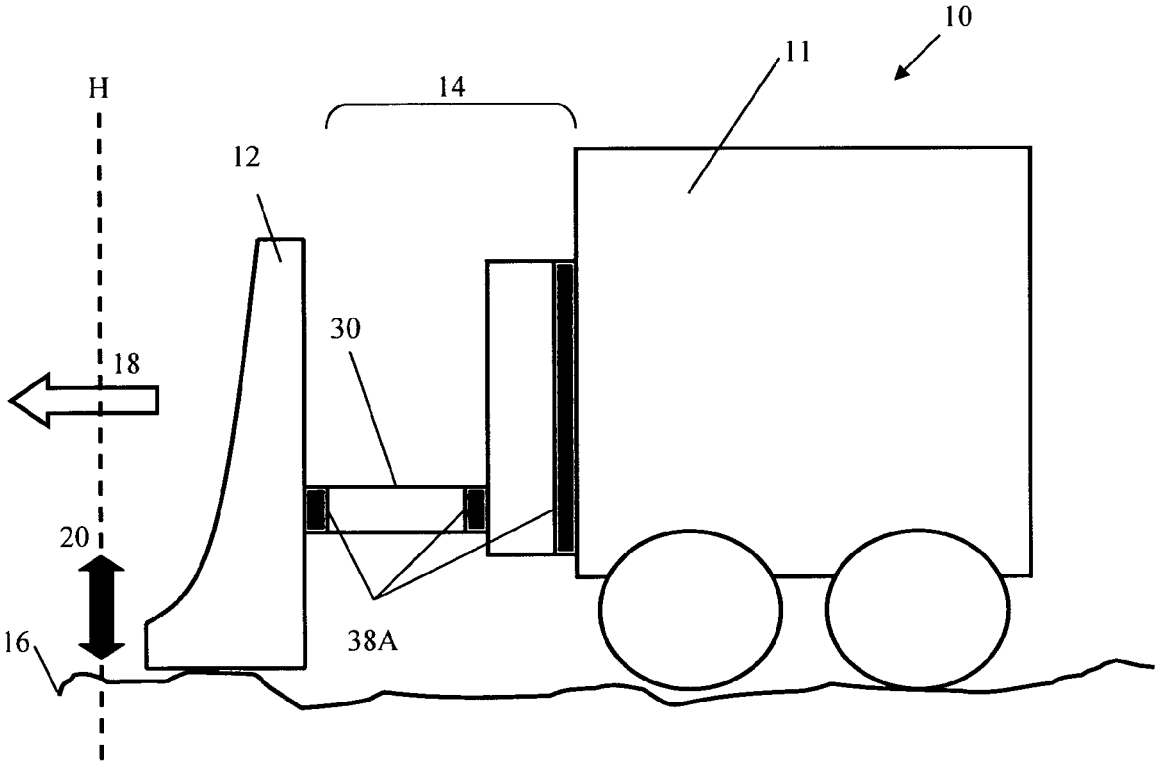
FIG. 2 shows a longitudinal cross section of an excavator according to an embodiment of the invention.

FIG. 2 schematically shows an excavator 10, whose drive unit 11 moves an excavator blade 12 over a hard and rough underlying surface 16 in the direction shown by the block arrow 18. The excavator blade 12 is arranged to oscillate in the substantially vertical plane 20 and follow the underlying surface contours 16, whereby the excavator blade 12 becomes easier to move forwards. At the same time the underlying surface 16 becomes more scraped clean and the forces to which the blade mounting 14 is subjected lower. The mounting device comprises two arms 30 that can be supporting arms or lift arms, whose length is either adjustable or non-adjustable.

FIG. 2 indicates the different locations in which resilient means 38 can be arranged on one side A of the mounting device 14 in order to achieve blade oscillation of the corresponding side (A) of the excavator tool 12 in at least one plane, such as the substantially vertical plane that is indicated by the block arrow 20. Resilient means 38 may namely be arranged in two different locations on each side A, B of the mounting device 14 by the connection of each arm 30 to the excavator blade. Alternatively, or additionally, resilient means 38 can be arranged by the connection of each arm 30 to the mounting device 14. Alternatively, or additionally, resilient means 38 can be arranged by the connection of the mounting device 14 to the drive unit 11.

Figure 3:
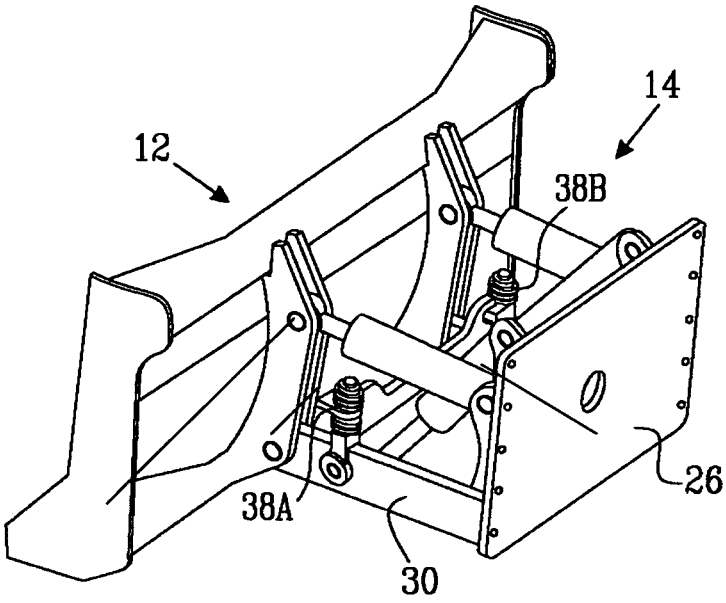
FIG. 3 shows an excavator blade with a mounting device according to an embodiment of the invention shown at an angle from behind.
Figure 4:
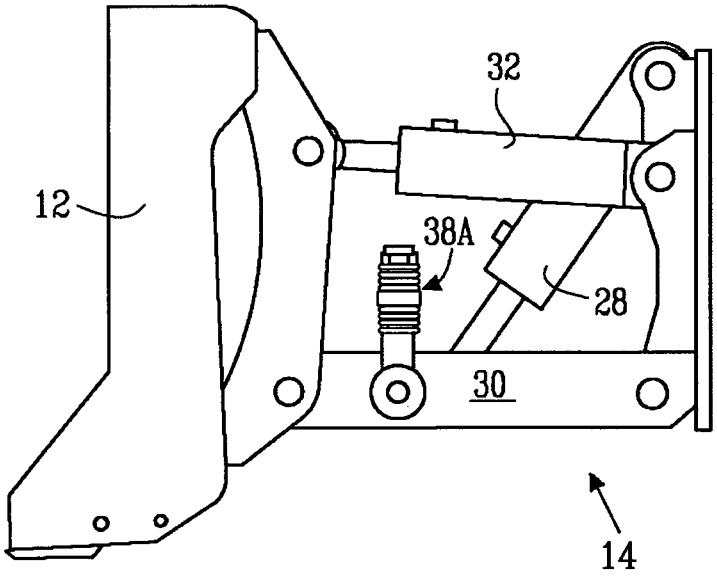
FIG. 4 shows a longitudinal cross section of an excavator tool and a mounting device according to an embodiment of the invention.

FIG. 3 and FIG. 4 show an excavator blade 12 and a mounting device 14 according to an embodiment of the invention seen from an angle from behind and from the side. In the illustrated embodiment a mounting plate 26 of the mounting device 14 is arranged to be fixedly connected to the excavator's drive unit 11. The mounting device 14 comprises two lift arms 30 that are individually maneuverable using individually maneuverable hydraulic lift cylinders 28. The mounting device also comprises two tilt cylinders 32. Each lifting arm 30 is connected to the excavator blade 12. It should be noted that an arm 30 does not necessarily have to be connected to the lower part of the excavator tool 12 or to the lower part of the mounting device 14.

In FIGS. 3 and 4 resilient means 38 are arranged between the mounting device 14 and the lift arms 30 at two different locations on each side (A and B) of the mounting device 14 in order to allow each lifting arm 30 to move in at least one plane relative to the mounting device 14, i.e. in the vertical plane in the illustrated embodiment, and consequently to make blade oscillation in this plane possible. The resilient means 38 are namely arranged in one plane that is substantially parallel to the plane in which the excavator tool 12 shall oscillate.

Figure 5:
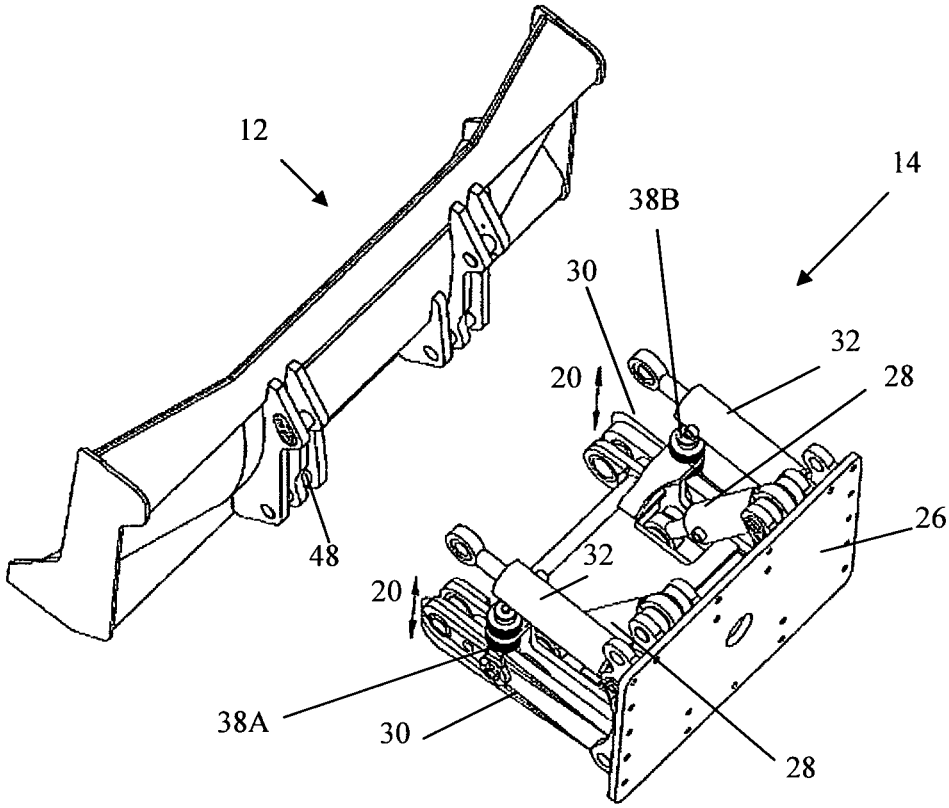
FIG. 5 shows an excavator blade with a mounting device according to an embodiment of the invention shown at an angle from behind.
Figure 6:
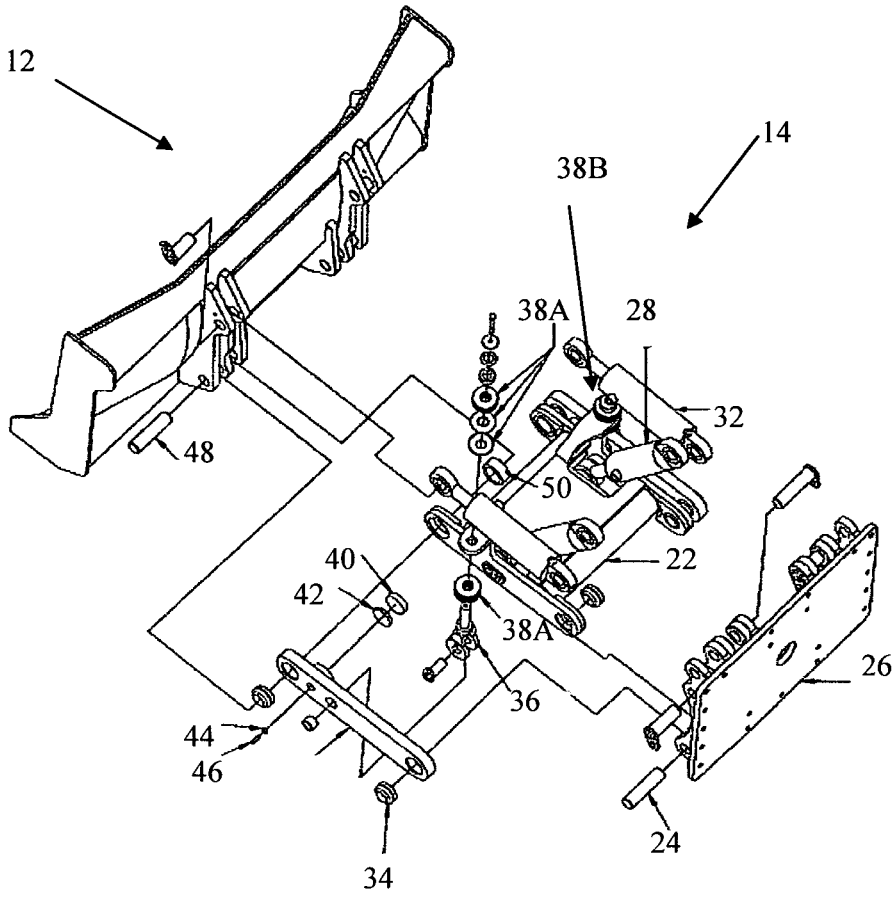
FIG. 6 shows an exploded view of a side of a mounting device according to an embodiment of the invention.

A more detailed sketch of the mounting device 14 that is shown in FIGS. 3 and 4, is shown in FIG. 5 and an exploded view of one side A of the mounting device 14 is shown in FIG. 6.

With reference to FIGS. 5 and 6, the mounting device 14 in the illustrated embodiment is symmetrical and comprises a twist-resistant bridge 22. It should however be noted that an excavator 10 according to the present invention does not necessarily need to be symmetrical as regards its construction and the placement of arms 30, connections between components and the type, rigidity, dimensions and the placement of resilient means 38. In other words the excavator 10 does not necessarily need to have the same structure on both of its sides.

The bridge 22 is mounted around a shaft 24 on a mounting plate 26 and connected to two lift cylinders 28. Two lift arms 30 are also mounted on the same shaft 24. Both lift arms 30, the bridge 22, lift cylinders 28 and the two tilt cylinders 32 are mounted on spherical joint bearings 34.

The lift arms 30 are connected to the bridge 22 via a fork 36 and resilient means 38A, 38B, such as cup springs. The lift arms 30 front end can therefore move up and down in the vertical plane 20 in relation to the bridge 22. The resilient means 38 are arranged to strive after holding the lift arms 30 parallel to the bridge 22.

The lift arms 30 are locked against transverse movements using locking means, such as slide rails 40 that comprise plastic for example and that are adjacent to the side of the bridge 22. The slide rails 40 are adjustable using a support plate 42 and a switch lever 46 which is locked using a nut 44.

The compressive force that is used to move the excavator blade 12 forwards when excavating is completely taken up by the lift arms 30. The excavator blade 12 is fixedly mounted on the lift arms' 30 front holes on joint bearings via the shaft 48. The bridge's 22 front ears have integrally mounted limiting sleeves 50. In an unloaded state the centre of the limiting sleeves coincides with the shaft 48. The limiting sleeves 50 have a greater inner diameter than the shaft's 48 outer diameter. For example, the limiting sleeves 50 have an inner diameter up to 5 cm greater than the shaft's 48 outer diameter. The excavator blade connection can therefore move up or down in the vertical plane 20 as much as the difference between the shaft's 48 outer radius and the limiting sleeves' 50 inner radius, i.e. up to 5 cm in the given example. The reciprocating movement can however be freely selected by using sleeves 50 with a different inner diameter. An oscillation distance of up to 10 cm or greater, may for example be selected depending on the application.

By mounting an excavator blade 12 on a mounting device 14 of an excavator 10 according to the present invention the excavator blade can be moved in the following way:

i) when the excavator blade is being moved, the excavator blade 12 lies on and follows the underlying surface contours 16 with its dead weight. The lift cylinders 28 are not used to lift the excavator blade 12.

ii) when the excavator blade is being moved in a non-loaded state, the excavator blade 12 lies on and follows the underlying surface contours 16 with less than its dead weight. The lift cylinders 28 provide a certain lifting force, for example via a gas accumulator (not shown). The excavator 10 thereby has better traction.

iii) when the excavator blade is being moved in a loaded state, the excavator blade 12 lies on and follows the underlying surface contours 16 with more than its dead weight. The lift cylinders 28 provide a certain lifting force, for example via a gas accumulator (not shown). The surface is therefore scraped harder.

Many modifications of the invention would be apparent to a skilled person. For example, even though the claims concern an excavator, the invention is suitable for any engineering machine whatsoever, which engineering machine comprises a tool.

The invention claimed is:

1. Excavator (10) that comprises a drive unit (11), an excavator tool (12) and a mounting device (14) for the excavator tool (12), said mounting device (14) comprises at least two arms (30) that are arranged to be connected to the excavator tool (12), whereby said excavator (10) comprises resilient means (38) that are located in at least two different locations (A, B), said resilient means (38) being arranged to allow the excavator tool (12) to move in at least one plane (20) relative to the drive unit (11) when said excavator tool (12) is mounted on the mounting device (14) and thereby allow the excavator tool (12) to oscillate in said at least one plane, wherein said at least two arms (30) are individually maneuverable.

2. Excavator (10) according to claim 1, wherein said mounting device (14) is arranged to be fixedly connected to the drive unit (11) and said at least two arms (30) are arranged to be movably connected to the excavator tool (12) via first connections, whereby said resilient means (38) is arranged by said first connections.

3. Excavator (10) according to claim 1, wherein said mounting device (14) is arranged to be fixedly connected to the drive unit (11) and said at least two arms (30) are arranged to be movably connected to a part of the mounting device (14) via second connections whereby said resilient means (38) are arranged by said second connections.

4. Excavator (10) according to claim 1, wherein said mounting device (14) is arranged to be movably connected to the drive unit (11) via third connections and said resilient means (38) are arranged by said third connections.

5. Excavator (10) according to claim 1, wherein said resilient means (38) are arranged to only allow the excavator tool (12) to move in substantially one plane (20) relative to the drive unit (11).

6. Excavator (10) according to claim 5, wherein said one plane (20) is a vertical plane (H), said vertical plane being perpendicular to an extension of the excavator tool in the longitudinal direction.

7. Excavator (10) according to claim 1, wherein said resilient means (38) comprise a resilient material, a mechanical spring or a pneumatic spring.

8. Excavator (10) according to claim 1, wherein said at least two arms (30) are lift arms.

9. Excavator (10) according to claim 1, wherein said at least two arms (30) are mounted in spherical bearings (34) in said mounting device (14).

10. Excavator (10) according to claim 1, wherein said excavator comprises locking means (40, 42, 44, 46) to prevent the excavator tool (12) from being able to move in at least one plane relative to the drive unit (11).

11. Mounting device (14), wherein said mounting device is arranged to be used in an excavator (10) according to claim 1, whereby the mounting device (14) comprises resilient means (38) that are located in at least two different locations (A, B), said resilient means are arranged to allow said excavator tool (12) to move in at least one plane relative said drive unit (11) when the excavator tool (12) is mounted on the mounting device (14) and thereby allow the excavator tool (12) to oscillate in said at least one plane.

12. Excavator tool (12), wherein said excavator tool is arranged to be used in an excavator (10) according to claim 1 or to be mounted on a mounting device (14) according to claim 12, whereby the excavator tool (12) comprises resilient means (38) that located in at least two different locations (A, B), said resilient means are arranged to allow the excavator tool (12) to move in at least one plane relative to the drive unit (11) of the excavator when the excavator tool (12) is mounted on a mounting device (14) of the excavator and thereby allow the excavator tool (12) to oscillate in said at least one plane.

13. Excavator (10) according to claim 2, wherein said resilient means (38) are arranged to only allow the excavator tool (12) to move in substantially one plane (20) relative to the drive unit (11).

14. Excavator (10) according to claim 3, wherein said resilient means (38) are arranged to only allow the excavator tool (12) to move in substantially one plane (20) relative to the drive unit (11).

15. Excavator (10) according to claim 4, wherein said resilient means (38) are arranged to only allow the excavator tool (12) to move in substantially one plane (20) relative to the drive unit (11).

16. Excavator (10) according to claim 2, wherein said resilient means (38) comprise a resilient material, a mechanical spring or a pneumatic spring.

17. Excavator (10) according to claim 2, wherein said at least two arms (30) are lift arms.

18. Excavator (10) according to claim 2, wherein said at least two arms (30) are mounted in spherical bearings (34) in said mounting device (14).

19. Excavator (10) according to claim 2, wherein said excavator comprises locking means (40, 42, 44, 46) to prevent the excavator tool (12) from being able to move in at least one plane relative to the drive unit (11).

20. Excavator (10) according to claim 3, wherein said excavator comprises locking means (40, 42, 44, 46) to prevent the excavator tool (12) from being able to move in at least one plane relative to the drive unit (11).

* * * * *

UNITED STATES PATENT AND TRADEMARK OFFICE

CERTIFICATE OF CORRECTION

PATENT NO. : 8,555,996 B2
APPLICATION NO. : 12/736603
DATED : October 15, 2013
INVENTOR(S) : Martinsson et al.

It is certified that error appears in the above-identified patent and that said Letters Patent is hereby corrected as shown below:

In the Claims

Claim 12, Column 7, Line 9: Delete "claim 12", and substitute --claim 11--.

Signed and Sealed this
Twenty-fifth Day of February, 2014

Michelle K. Lee

Michelle K. Lee
*Deputy Director of the United States Patent and Trademark Office*